United States Patent [19]

Drabowitch et al.

[11] Patent Number: 4,857,936

[45] Date of Patent: Aug. 15, 1989

[54] CONICAL SWEEP ARRAY ANTENNA AND A RADAR HAVING SUCH AN ANTENNA

[75] Inventors: Serge Drabowitch, Chatenay-Malabray; Jean Bouko, Villemoisson, both of France

[73] Assignee: Thomson-CSF, Paris, France

[21] Appl. No.: 918,255

[22] Filed: Oct. 14, 1986

[30] Foreign Application Priority Data

Oct. 22, 1985 [FR] France ..... 8515663

[51] Int. Cl.[4] ..... H01Q 3/26

[52] U.S. Cl. ..... 342/368; 342/425

[58] Field of Search ..... 342/368, 371, 372, 425; 343/776, 777, 786, 808, 700 MS, 911 R

[56] References Cited

U.S. PATENT DOCUMENTS

| | | | |
|---|---|---|---|
| 2,677,055 | 4/1954 | Allen | 343/776 |
| 2,751,586 | 6/1956 | Riblet . | |
| 3,008,142 | 11/1961 | Saltzman | 342/372 X |
| 3,045,238 | 7/1962 | Cheston . | |
| 3,147,479 | 9/1964 | Williams . | |
| 3,495,262 | 2/1970 | Paine | 343/776 |
| 3,821,740 | 6/1974 | Ehrlich | 342/374 |
| 3,893,124 | 7/1975 | Barker | 342/368 X |
| 3,983,562 | 9/1976 | Blanchard et al. . | |
| 4,065,771 | 12/1977 | Gulick et al. | 342/368 |
| 4,378,559 | 3/1983 | Rittenbach . | |
| 4,387,378 | 6/1983 | Henderson | 342/374 |
| 4,414,550 | 11/1983 | Tresselt | 342/373 |
| 4,460,898 | 7/1984 | Silinsky . | |
| 4,633,256 | 12/1986 | Chadwick | 342/368 |

*Primary Examiner*—Thomas H. Tarcza
*Assistant Examiner*—Tod Swann
*Attorney, Agent, or Firm*—Cushman, Darby & Cushman

[57] ABSTRACT

A conical sweep array antenna has a flat antenna structure having a plurality of microstrip sources disposed in a plurality of sections. Preferably, each section includes a plurality of sources. The flat antenna also has at least one source disposed outside any of the sections. A phase-shifting device phase-shifts the plurality of sources to cause a conical sweep pattern of the flat antenna. Also, the phase-shifter device provides a constant phase-shift to the one source which is not disposed in any section. The presence of the nonphase-shifted source improves the radiating diagram of the antenna of the invention, particularly by reducing the coma lobe.

18 Claims, 4 Drawing Sheets

CONICAL SWEEP ARRAY ANTENNA AND A RADAR HAVING SUCH AN ANTENNA

BACKGROUND OF THE INVENTION

1. Field of the Invention

The invention relates principally to a conical sweep array antenna and a radar comprising such an antenna.

2. Description of the Prior Art

The book "Les Antennes, application aux radars et aux techniques spatiales" by Léo Thourel, second edition published by Dunod in 1971 describes, on pages 409, a flat antenna with a conical sweep. This book describes an antenna having groups of radiating slit guides. These guides are grouped in four identical quadrants fed by four excitation wave guides situated behind. Each of the quadrants forms an equiphase group, whose phase center is at the barycenter of the excitation amplitudes of said slits. Because of the identity of the four groups, the phase barycenters form the apex of a square whose center is the center of the antenna. If the four quadrants are fed in phase, the whole of the antenna is equiphase and the maximum radiation appears along the axis normal to the plane of the antenna, passing through its center. The conical sweep is achieved by feeding each of the quadrants through a phase shifter. The successive phase shift of the different quadrants allows a slope of the energy beam to be obtained.

The author emphasizes two serious defects of this device, first the level of the distant secondary loads is always very high and the gain factor is low. In fact, the diagram obtained is the product of the diagram of a quadrant multiplied by the alignment factor of the four barycenters which are always distant by more than a wave length. Second order lobes therefore inevitably appear (lobe of the arrays). In addition, the gain is reduced by the presence of these lobes and is affected by the losses in the phase shifters, which are often of the order of half a decibel, and which is deducted from the gain of the antenna alone.

SUMMARY OF THE INVENTION

The present invention relates to a conical sweep flat antenna having, in addition to the four quadrants whose radiation is likely to be phase shifted, radiation sources placed for example at the center of the antenna whose phase shift with respect to the supply energy is constant.

The conical sweep allows high accuracy to be obtained in determining the direction of a target. Conical sweep antennae are used more particularly for tracking radar and for trajectory calculation radar. Directional antennae of the Cassegrain type, with a beam opening at half power of the order of 1°, are used more particularly in a trajectory calculation radar. The great directivity of these antennae provides high precision tracking. On the other hand, target acquisition at the outset is fairly difficult. In addition, the problem of initial acquisition may arise again after a loss, after said target has been masked by obstacles such for example as a building or trees.

The present invention provides a wide beam conical sweep antenna, having for example a beam opening at half power of the order of 10°. This antenna has low precision, but a great probability of initial detection. The wide opening beam antenna of the invention performs particularly well and may form a secondary antenna associated with a primary conical sweep antenna with small beam opening, the main antenna being for example of the Cassegrain type.

The invention provides principally a flat antenna comprising elementary sources, the circular permutation in the plane of the antenna of the phase shift of some of said sources with respect to the others allowing a conical sweep to be obtained, wherein at least one elementary source is provided whose phase shift is constant.

BRIEF DESCRIPTION OF THE DRAWINGS

The invention will be better understood from the following description of the accompanying Figures given by way of non limitative examples, in which:

In FIGS. 1 to 13 the same references have been used to designate the same elements.

DESCRIPTION OF THE PREFERRED EMBODIMENTS

Figure 1:
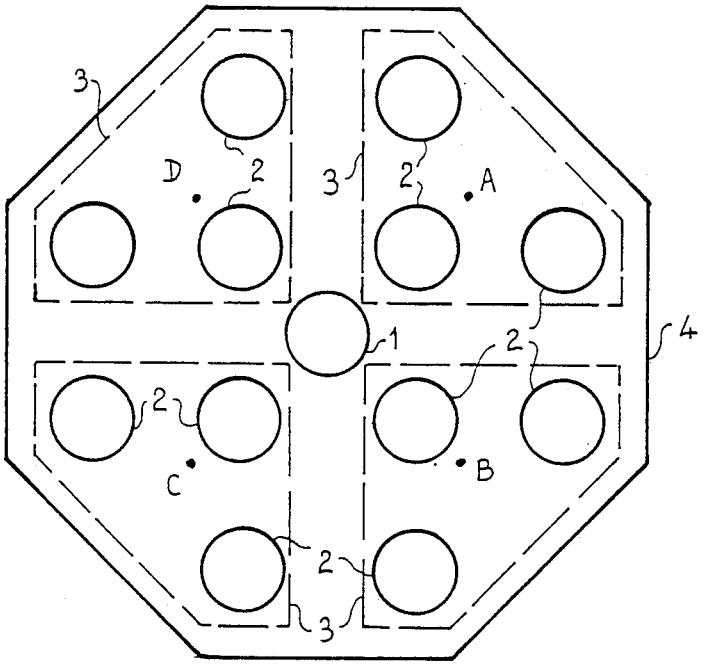
FIG. 1 is a front view of a first embodiment of the antenna of the invention.

In FIG. 1, an improved conical sweep array network has been shown.

Antenna 4, illustrated in FIG. 1, has four quadrants 3. In the non limitative examples shown, each quadrant 3 comprises three elementary sources 2. The points A, B, C, D represent the phase centers of the quadrants 3 situated at the barycenters of the amplitudes emitted by the sources 3. Antenna 4 further includes, in addition to the sources belonging to quadrants 3, a source 1, placed for example in the center of the antenna. The sources 2 of the four quadrants 4 and the source 1 are fed with energy for example from a single oscillator. The sources 2 of quadrants 3 are fed through a variable phase shifter, having for example two states. The phase shift of the central source 1 with respect to the energy fed by the oscillator is fixed. By effecting the circular permutation of the phase shifts applied to the different quadrants 3, the conical sweep is obtained.

In a first embodiment of the antenna of the invention, a phase shift is applied to one of the quadrants 3 with respect to the other three. This phase shift is permuted in a circular fashion. For example, in a first stage the phase shift is applied to the quadrant whose phase center is point A. In a second stage, the phase shift is applied to the quadrant 3 whose phase center is point B. In a third stage, the phase shift is applied to the quadrant 3 whose phase center is point C. In a fourth stage, the phase shift is applied to the quadrant 3 whose phase center is point D. In a fifth stage, the phase shift is applied to the quadrant 3 whose phase center is point A and so on.

Advantageously, the same phase shift is applied to two successive quadrants 3. Similarly, circular permutation of these phase shifts is provided. Thus, for example, in a first stage of phase shift is applied to the quadrants 3 whose phase centers are point A and point B. In a second stage a phase shift is applied to the quadrants 3 whose phase centers are point B and point C. In a third stage a phase shift is applied to the quadrants 3 whose phase centers are point C and point D. In a fourth stage, a phase shift is applied to the quadrants 3 whose phase centers are point D and point A. In a fifth stage, a phase shift is applied to the quadrants 3 whose phase centers are point A and point B, and so on.

It is obvious that the circular permutation may be effected in the opposite direction.

In a third variant of the phase shift of the antenna 4 of the invention, the phase of the elementary sources 2 varies with the abscissa and the ordinate of these sources on the surface of antenna 4. The phase shift is for example the greatest for the endmost sources 2 of the quadrant 3 whose phase center is point A, the phase shift decreasing the closer to the endmost elementary sources 2 of the quadrant 3 whose phase center is point C. Then, circular permutation of these phase shifts is carried out similarly to one of the two preceding examples of phase shift on the antenna.

Advantageously, the fixed phase shift of the central source 1 is between the phase shift of the source belonging to a phase shifted quadrant 3 and that of the sources belonging to a non phase shifted quadrant 3.

Advantageously, the phase shift of the central source 1 is equal to half the value of the relative phase shift of the sources 2 belonging to a phase shifted quadrant 3 with respect to a source 2 of a non phase shifted quadrant 3.

The use of an elementary source 1 radiating a phase shift which is constant with respect to the oscillator appreciably improves the quality of the radiating diagram of the antenna 4, particularly by lowering the coma lobes.

Figure 2:
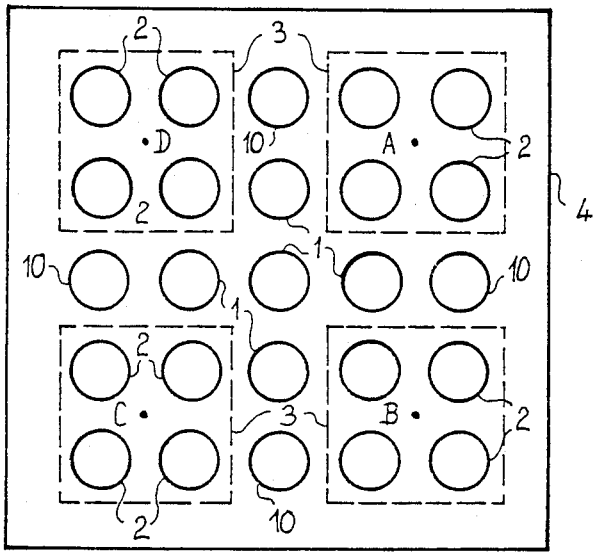
FIG. 2 is a front view of a second embodiment of the antenna of the invention.

In FIG. 2, another arrangement of the elementary radiating sources 1 and 2 can be seen. The antenna includes five elementary sources 1 placed in the form of a cross in the center of antenna 4. The sources are spaced apart evenly over the surface of antenna 4.

In the example illustrated in FIG. 2, the four quadrants 3 each have four elementary sources 2. A variant of the antenna 4 of the invention has four additional sources 10 phase shifted for example with respect to the constant feed oscillator, placed at the ends of the cross formed by the assembly of the elementary sources 1. The phase shift is obtained in the same way as for the device of antenna 4 shown in FIG. 1. The variation of phase shift with the abscissa and the ordinate of sources 2 on the surface of antenna 4 is obtained in the case of antenna 4 shown in FIG. 2, for example, by using digital two bit phase shifters providing four phase shift positions.

FIGS. 3 to 8 show different embodiments of the elementary radiating sources 1, 2 or 10.

The sources illustrated in FIGS. 3 to 8 are known per se.

Figure 3:
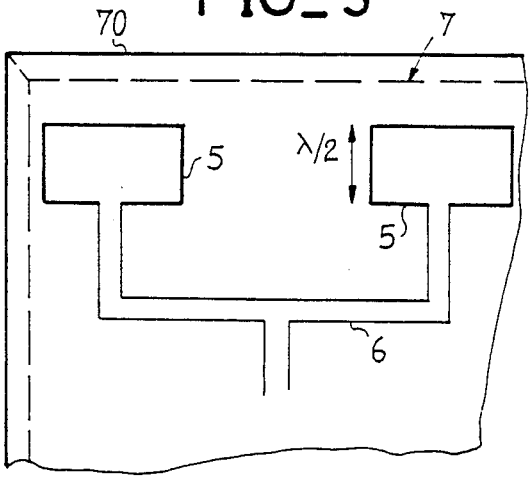
FIG. 3 is an illustration of a first embodiment of radiating sources used in the antenna of the invention.

In FIG. 3, two elementary sources 5 are shown of the patch type. The patch sources 5 are fed by a distribution tree 6. The sources are formed using the so called microstrip technology, which consists in depositing metallizations on a dielectric 70 whose opposite face comprises a metallized ground plane 7. The patch sources 5 are widened portions of the supply metallization whose width is for example equal to $\lambda/2$, $\lambda$ being the wave length of the radiations in free space.

Figure 4:
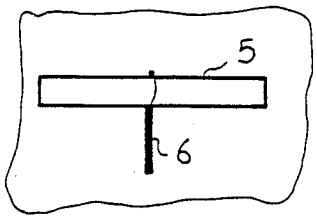
FIG. 4 is an illustration of a second embodiment of radiating sources used in the antenna of the invention.

In FIG. 4, an elementary source 5 has been shown formed by a radiating slit.

Figure 5:
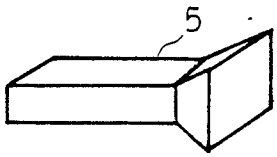
FIG. 5 is an illustration of a third embodiment of radiating sources used in the antenna of the invention.

In FIG. 5, an elementary source has been shown formed by a horn. The horn illustrated in the non limiting example of FIG. 5 is a rectangular horn.

Figure 6:
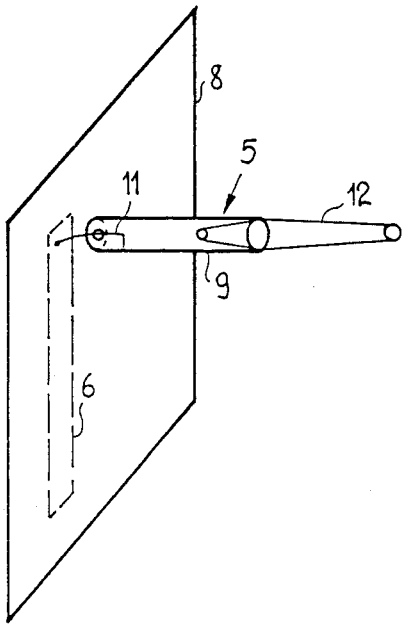
FIG. 6 is an illustration of a fourth embodiment of radiating sources used in the antenna of the invention.

In FIG. 6, an elementary source 5 has been shown of the dielectric candle type 12. Source 5 is fed by a strip 6 coupled through a wall 8 to a circular wave guide 9. At the end of the wave guide is placed a dielectric piece 12 of an elongate shape giving the name of candle to the whole of the elementary source 5.

Figure 7:
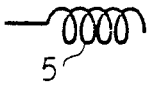
FIG. 7 is an illustration of a fifth embodiment of radiating sources used in the antenna of the invention.

In FIG. 7 a helix type elementary source 5 can be seen.

Figure 8:
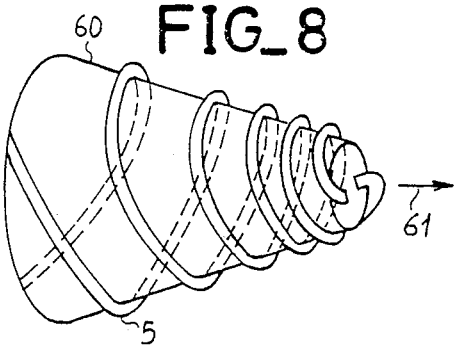
FIG. 8 is an illustration of a sixth embodiment of radiating sources used in the antenna of the invention.

In FIG. 8, is shown a double logarithmic spiral wound on a cone 6. Arrow 61 shows the direction of radiation of source 5.

Figure 9:
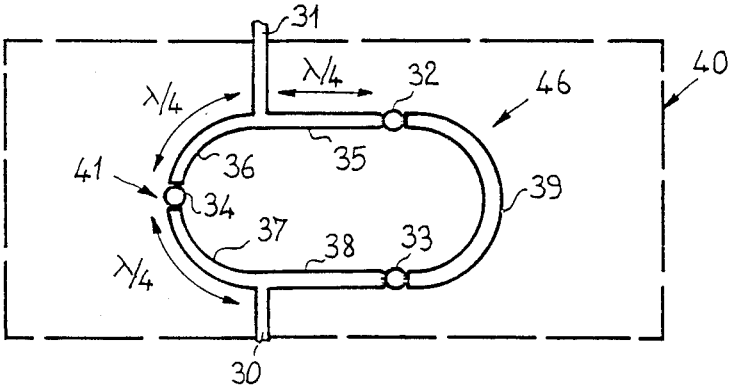
FIG. 9 is an illustration of the principle of the phase shift by switching.

In FIG. 9, a phase shifter 40 is shown called switching phase shifter. Phase shifter 40 includes two paths 41 and 46 of different lengths. Depending on whether the signal follows, between an input 30 and an output 31, the longest path 46 or the shortest path 41 the phase shift of the signal present at output 31 of the phase shifter 40 will be more or less great with respect to the signal present at the input 30 of phase shifter 40. Switching between the two paths 41 and 46 is obtained by switching from the saturated state to the disabled state of the PIN diodes 32, 33 and 34. In the example illustrated in FIG. 9, path 41 has a length equal to $\lambda/2$, diode 32 is placed half way, at an equal distance $\lambda/4$, from the input 30 and from the output 31. Path 46 comprises two PIN diodes 33 and 32 placed respectively at a distance equal to $\lambda/4$ from the input 30 and from the output 31 of phase shifter 40. The device, not shown in FIG. 9, for switching the PIN diodes for example diode 34 in its saturated state and diodes 32 and 33 in their disabled state, allows the signal to pass through leg 41. Similarly, a disabling of diodes 34 and enabling of diodes 32 and 33 allows the signal to pass through leg 46.

In FIG. 9, the phase shifter 40 has two legs 41 and 46 providing two different phase shifts. The phase shifter 40 shown in FIG. 9 is called a one bit phase shifter. Of course, phase shifter 40 may have a larger number of legs providing a larger number of phase shifts. Similarly, the invention is not limited to the use of switching phase shifts. Other types of phase shifts may be used for constructing the flat conical sweep antenna of the invention.

Figure 10:
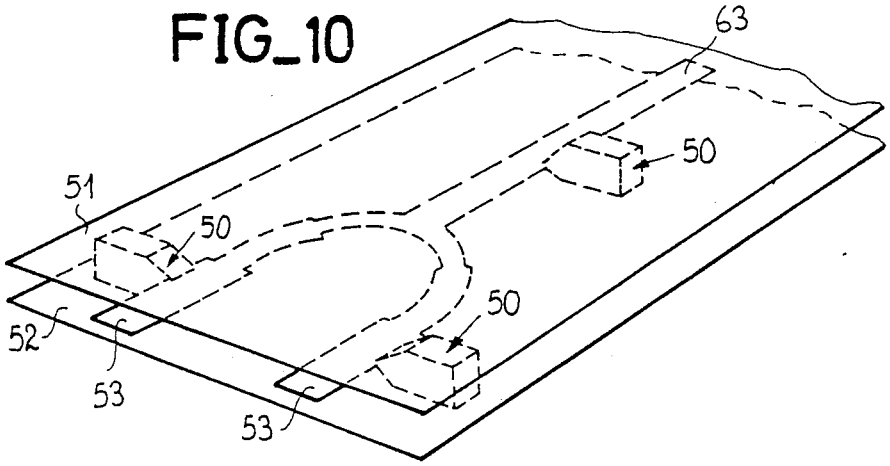
FIG. 10 is a perspective view of the feed lines used in the antenna of the invention.

In FIG. 10, a three plate feed line is shown. The three plate line may be particularly advantageous for feeding and/or phase shifting the energy supplied to the elementary sources. A three plate line is described in the French Pat. No. 2,496,996 filed by the applicant.

In FIG. 10 a detail has been shown of a three plate line providing the balanced division of energy between an input 63 and two output 53. The energy distribution is provided by a metal strip, made for example from copper. The copper strip is placed between two metal plates 51 and 52. The dielectric supports 50 provide constant spacing between the metal strip and plates 51 and 52. The air present between plates 51 and 52 plays the role of dielectric, without for all that generating power losses.

Advantageously, the antenna of the invention has a wide energy beam. For example, the antenna illustrated in FIG. 1, whose elementary souces are dielectric candles such as illustrated in FIG. 6, has an opening at half power of the beam of the order of 10°. It is therefore advantageous to associate it with a trajectory calculation radar antenna of Cassegrain type.

Figure 11:
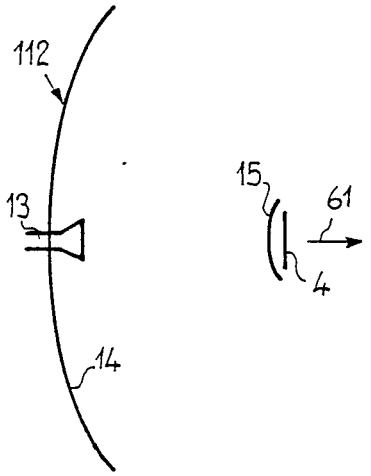
FIG. 11 is a diagram illustrating the relative arrangement of the flat conical phase shift antenna with respect to a conical sweep antenna of Cassegrain type with which it is associated.

In FIG. 11, an example is shown of associating a Cassegrain antenna 112 with an antenna 4 such as described above. The Cassegrain antenna has a radiating source 13 placed facing an auxiliary mirror 15 and passing through a main mirror 14.

Advantageously, the flat antenna 4 is placed on the face opposite the source 13 of the auxiliary mirror 15. Arrow 61 shows the main directions of the radiation of antenna 4 and of the Cassegrain antenna 112.

The example shown in FIG. 11 is of course in no way limiting. Antenna 4 may be placed for example beside the Cassegrain antenna 112. It is however important for antenna 4 not to disturb the radiation emitted and received by the Cassegrain antenna 112.

The association of a conical sweep antenna 4 with a radar having a conical sweep Cassegrain antenna 112 allows the radar processing chain of the main antenna 112 to be used for processing the signals received in antenna 4.

The invention is not limited to wide beam flat antennae. The invention also allows conical sweep flat antennae to be constructed of low cost and with the desired beam opening.

Figure 12:
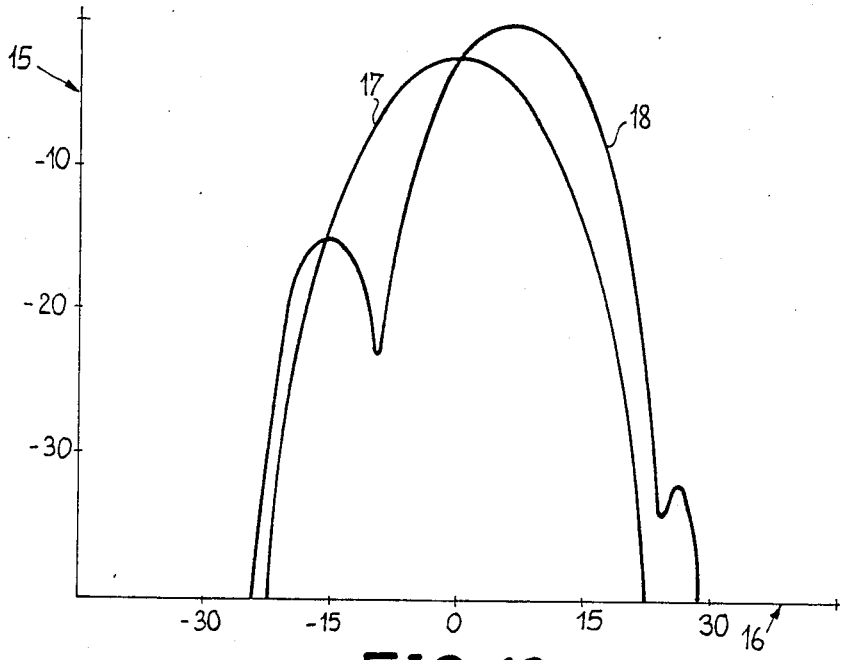
FIG. 12 shows radiating curves of the antenna of known type.

In FIG. 12, curves showing the performances of the antennae of known type can be seen. For facilitating comparison with the curves of FIG. 13, the same radiating sources have been used as for the construction shown in FIGS. 12 and 13. These radiating sources are dielectric candles such as shown in FIG. 6.

As abscissa 16 has been shown the azimuth in degrees and as ordinates 15 has been shown the power in decibels.

Curve 17 shows the radiating diagram of an antenna whose four quadrants 13 radiate in phase. Curve 18 shows the radiating diagram of the same antenna whose conical sweep is obtained by phase shifting two quadrants 3 with respect to the other two quadrants 3.

Figure 13:
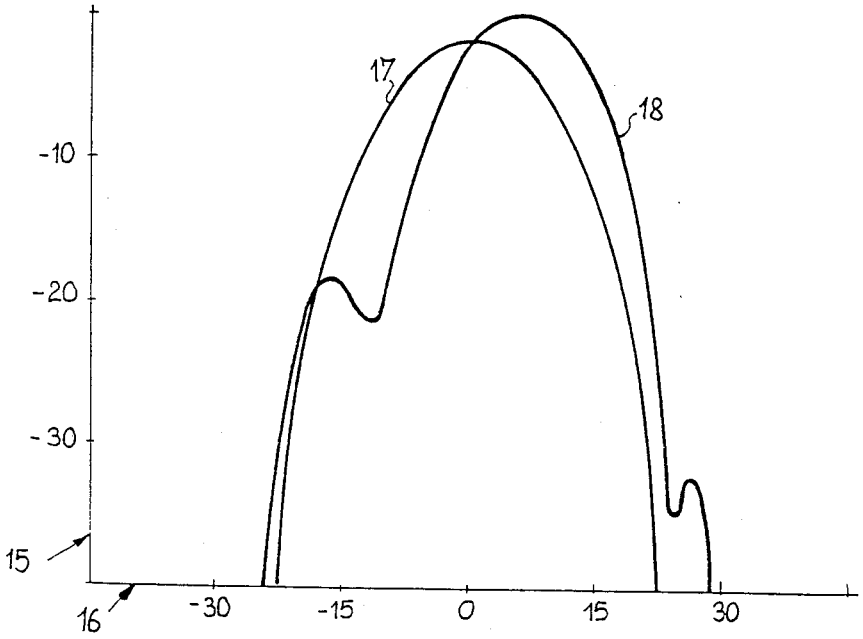
FIG. 13 shows curves of the antenna of the invention.

In FIG. 13, the performance of the antennae of the invention such as illustrated in FIG. 1 can be seen. Curve 17 shows a radiating diagram of all the sources 2 and 1 emitting in phase. Curve 17 shows the radiating diagram when two quadrants 3 have a phase shift with respect to the other two, the central source 1 having a phase shift smaller by half. As can be seen the antenna of the invention has perfomances superior to the known type antenna, particularly in that the secondary lobes are smaller.

The invention applies particularly to the construction of conical sweep antennae with wide beam for the acquisition of targets in a trajectory calculation radar, tracking being provided by a Cassegrain antenna with narrow beam conical sweep.

The invention also applies to the construction of low cost conical sweep antennae.

What is claimed is:

1. A conical sweep array antenna, comprising:

flat antenna means having (1) a plurality of microstrip sources, disposed in a plurality of sections, and (2) at least one source disposed outside of said sections; and means for phase-shifting said plurality of sources to cause a conical sweep pattern of said antenna, and for maintaining a constant phase-shift amount to said at least one source every time, so that said at least one source always has the same phase shift.

2. An antenna according to claim 1 wherein each of said sections includes a plurality of sources.

3. An antenna according to claim 1 wherein said flat antenna means includes four sections, and wherein said at least one source is disposed in a center location of said four sections.

4. An antenna according to claim 1 wherein said flat antenna means includes four sections of sources, and wherein a plurality of sources are disposed outside said four sections, said plurality of sources disposed outside said four sections being provided with a constant phase-shift.

5. An antenna according to claim 1 wherein said at least one source is disposed at a central location with respect to said plurality of sections.

6. An antenna according to claim 1 wherein said means for phase-shifting comprises, a plurality of switching phase-shifters.

7. An antenna according to claim 1 wherein said means for phase-shifting includes means for shifting a first plurality of said sources by a predetermined value, and for not phase-shifting a second plurality of said sources, and for providing said constant phase-shift amount to said at least one source with a value which is intermediate between the value of said first plurality of sources and a value of said second plurality of sources.

8. An antenna according to claim 7 wherein said means for phase-shifting includes means for setting said constant phase-shift amount at a value approximately one-half the value of the phase-shift of said first plurality of sources.

9. An antenna according to claim 1 wherein said flat antenna means includes four sections, and wherein said means for phase-shifting phase-shifts the sources within each section with the same phase-shift, two adjacent sections with identical phase-shift being formed at any time.

10. An antenna according to claim 1 wherein said flat antenna means includes four sections, and wherein said means for phase-shifting provides the same phase-shift to each section, three sections having the same phase-shift with respect to the fourth section at any time.

11. An antenna according to claim 1 wherein said means for phase-shifting includes phase-shifters holding at least four values.

12. An antenna according to claim 1 wherein said means for phase-shifting includes at least one switching phase-shifter, said phase-shifter having first and second paths of different length, each path including at least one PIN diode.

13. A conical sweep Cassegrain antenna, comprising:

a main radiation reflector;

a main source disposed in a central location of said main reflector;

an auxiliary radiation reflector facing said main source so as to reflect energy between said main source and said main reflector; and a conical sweep array antenna disposed so as not to disturb radiation emitted and received by said main reflector, said conical sweep array antenna including:

flat antenna means having (1) a plurality of microstrip sources disposed in a plurality of sections, and (2) at least one source disposed outside of said sections; and means for phase-shifting said plurality of sources to cause a conical sweep pattern of said array antenna, and for providing a constant phase-shift amount to said at least one source every time, so that said at least one source always has the same phase-shift.

14. An antenna according to claim 13 wherein each of said sections includes a plurality of sources.

15. An antenna according to claim 13 wherein said conical sweep array antenna is disposed on an opposite side of said auxiliary reflector from said main source.

16. An antenna according to claim 13 wherein said conical sweep array antenna is disposed at a side of said main reflector so as not to disturb radiation emitted from or collected by said main reflector.

17. An antenna according to claim 13 wherein said main source and said flat antenna means both include means for being coupled to the same radar signal processing circuitry.

18. An antenna according to claim 13 wherein said flat antenna means comprises four sections, and wherein said at least one source is disposed at a central location with respect to said four sections.

* * * * *